United States Patent [19]

Benoit

[11] 4,305,617

[45] Dec. 15, 1981

[54] CHAIR CONSTRUCTION

[75] Inventor: Roland A. Benoit, Danielson, Conn.

[73] Assignee: Interroyal Corp., New York, N.Y.

[21] Appl. No.: 39,004

[22] Filed: May 14, 1979

[51] Int. Cl.[3] ..... A47C 5/12; A47C 7/16

[52] U.S. Cl. ..... 297/445; 297/DIG. 2; 297/443; 297/452

[58] Field of Search ..... 297/445, 452, 239, DIG. 2, 297/195, 459, 457, 443; 264/249; 403/265, 277; 248/628

[56] References Cited

U.S. PATENT DOCUMENTS

| | | | |
|---|---|---|---|
| 2,248,413 | 7/1941 | Rathbun | 297/459 |
| 2,285,925 | 6/1942 | Handy | 297/459 X |
| 2,546,268 | 3/1951 | Legris | 248/628 |
| 3,124,439 | 3/1964 | Rittenhouse | 264/249 X |
| 3,245,715 | 4/1966 | Gits | 297/452 X |
| 3,284,136 | 11/1966 | Harrison | 297/445 X |
| 3,319,999 | 5/1967 | Lieberman et al. | 297/445 X |
| 3,328,075 | 6/1967 | Albinson | 297/239 |
| 3,476,496 | 11/1969 | Golden | 297/195 |
| 3,544,143 | 12/1970 | Ohlsson | 403/265 |
| 3,588,171 | 6/1971 | Rich | 297/195 |
| 3,669,496 | 6/1972 | Chisholm | 297/457 |
| 3,754,310 | 8/1973 | Shea | 264/249 X |
| 4,026,600 | 5/1977 | Kutaguchi | 297/195 |

FOREIGN PATENT DOCUMENTS

| | | | |
|---|---|---|---|
| 2016099 | 11/1971 | Fed. Rep. of Germany | 297/452 |
| 578849 | 7/1958 | Italy | 403/277 |

*Primary Examiner*—James T. McCall
*Attorney, Agent, or Firm*—Arthur A. March

[57] ABSTRACT

A chair back including a pair of spaced recesses for insertion engagement with corresponding projections on a chair frame, and a self-locking mechanism positioned on and connected to the back remote from the recesses for coacting locking engagement with a corresponding attachment portion on the frame, permitting self-securement of the back to the frame;

a chair seat including a surface for supporting engagement with a corresponding attachment aperture-containing plate on a chair frame, and a heat deformable and peripherally outwardly heat expansible hollow longitudinal boss connected to and extending outwardly from the surface for insertion through and projection beyond the aperture and in turn for heat deformation and peripherally outward expansion in situ thereat beyond the perimetric confines of the aperture and sufficiently to bring the exterior of the boss into locking engagement with the adjacent marginal portions of the plate remote from the surface, permitting rigid securement of the seat to the frame;

combinations of both the back and seat correspondingly secured to the frame, and especially with the boss disposed in heat deformed and peripherally outwardly expanded in situ condition, e.g. for providing a stacking and/or ganging chair; and a method of securing the seat to the frame, including locally heat deforming and expanding the hollow boss by inserting a heater element thereinto and applying heat and mechanical expansion pressure thereat, and permitting the boss to set in such in situ deformed and expanded condition.

29 Claims, 16 Drawing Figures

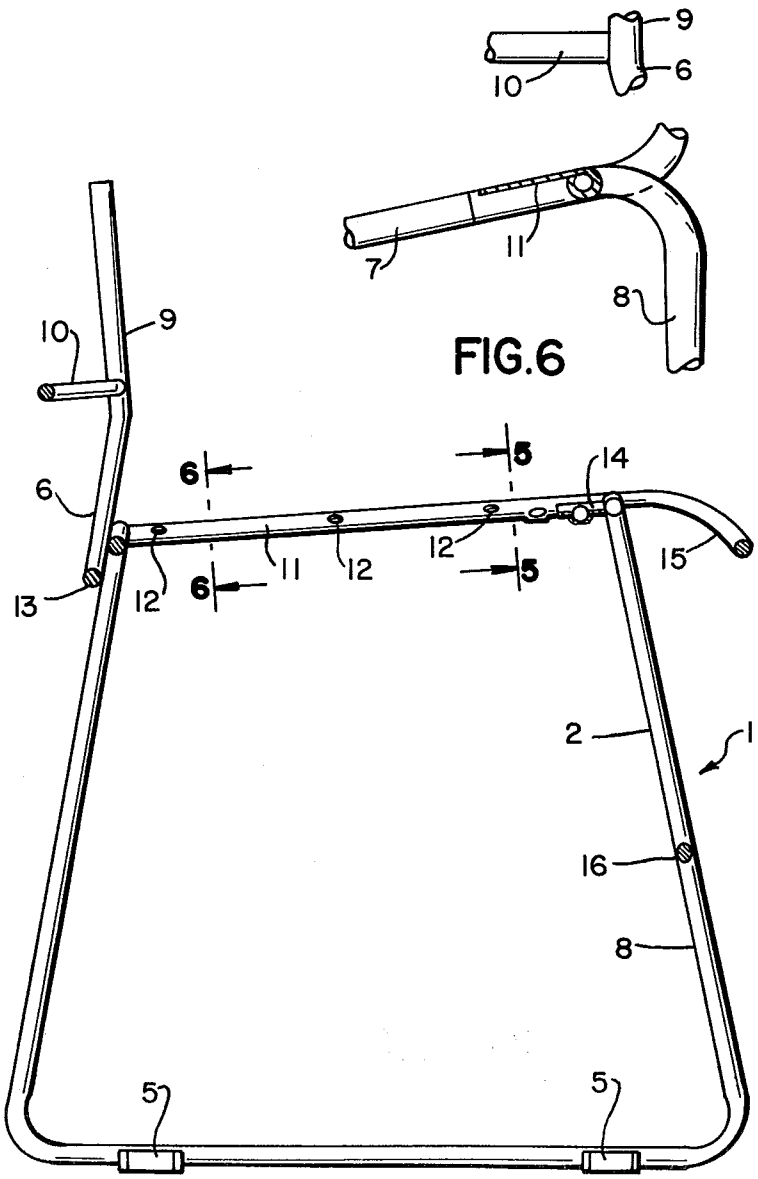
FIG.4
FIG.6
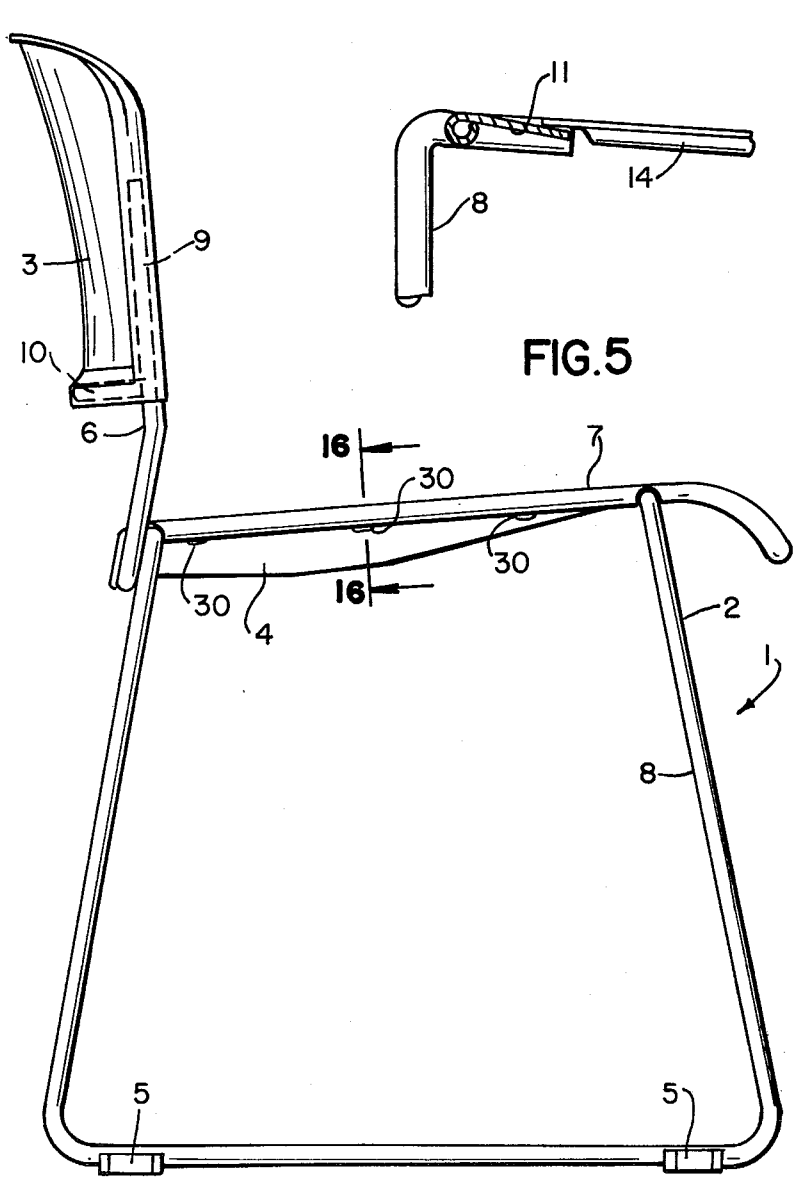
FIG.2
FIG.5

CHAIR CONSTRUCTION

The present invention relates to a chair construction, and more particularly to body-supportive chair parts such as a chair back and a chair seat, each of which contains means permitting the same to be secured to an appropriate chair frame to provide the corresponding chair assembly, especially a stacking and/or ganging chair, and also a method for securing such a chair part to the frame.

Many stacking or stackable and/or ganging or gangable chair constructions are known.

Thus, U.S. Pat. No. 3,328,075 (Albinson) shows a stacking and ganging chair comprising a pair of laterally spaced apart more or less right angle metal connectors, having upwardly extending arms onto which a plastic chair back is downwardly slid via cavities therein, as well as forwardly extending arms onto which a plastic chair seat is rearwardly slid via similar cavities therein, with the angle connectors being secured through spacing cleats to a ganging chair frame leg structure therebeneath via extraneous screw and nut connections. The chair back cavities require a critical angle of incline or taper toward each other in upward direction of substantially 10 degrees or greater relative to true vertical for effectively locking the upwardly extending arms therein. This is accomplished by a counterpart taper and toe-in towards each other of the forwardly extending arms for similar locking of the latter via appropriately tapered cavities in the chair seat.

Although in said U.S. Pat. No. 3,328,075 serrations are provided on the various arms to bite into the plastic of the cavities of the back and seat so as to prevent removal, the rear portions of the seat adjacent the open rear ends of the cavities therein are provided with corresponding flexible locking tabs more or less coaxially of the cavities and having shoulders which must be accurately positioned to engage the rear faces of the spacing cleats by snap action as the seat is slid onto the forwardly extending arms. This chair construction is clearly complicated in design, must be precisely fabricated, and thus is expensive to provide. Besides, the metal frame parts must be specially provided with such serrations for coacting engagement with the cavities in the back and seat parts.

Also, U.S. Pat. No. 3,724,897 (Faiks et al) shows a stacking and ganging chair of wire rod construction in which two rods extend more or less upwardly in side by side abutting welded relation from the central portion of the chair seat frame to form a twist connection thereat, and then diverge laterally more or less horizontally to the sides of the chair, whereupon the rods again project upwardly in laterally spaced apart relation, to accommodate a plastic chair back having an open edge groove continuously along its underside as well as along its upwardly extending lateral sides in conformity with the diverging rod configuration for linearly embracing the rod surfaces therealong, and upwardly terminating in end holes in which the upper ends of the rods are fixedly seated via predisposed adhesive in the end holes, or optionally via some acceptable, though undisclosed, mechanical fastening. This chair back mounting feature is intricate in design, requires numerous elaborate manipulations for fabricating the assembly, and is thereby similarly expensive to provide.

Another feature of said U.S. Pat. No. 3,724,897 concerns the manner of attachment of the plastic chair seat to the chair seat frame. Specifically, the seat frame is provided with lateral side plates containing slots and holes into which corresponding depending tabs and bosses respectively on the underside of the chair seat are downwardly inserted, whereupon extraneous screws are passed upwardly through the holes and into the bosses to secure the chair seat in place. Hence, in order to effectuate the attachment of the chair seat to the chair seat frame extraneous screws must be provided, manipulated and aligned, and then driven into the bosses, so that additional time and effort must be expended.

U.S. Pat. No. 3,838,884 (Faiks) constitutes a division of said U.S. Pat. No. 3,724,897, apparently containing essentially the same disclosure although directed to features of ganging such chairs together.

In U.S. Pat. No. 3,446,530 (Rowland), an arm rest subassembly is shown which may be attached to an existing stacking chair by welding. The subassembly includes a vertical support frame containing a specially shaped horizontal support plate provided with openings, and a separate arm rest of plastic or wood having a precisely shaped recess in its underside for registry with the support plate. The arm rest is secured to the support plate by screws passing upwardly through the openings in the support plate and into the body of the arm rest thereabove, or optionally where the arm rest is made of plastic by heat staking of the plastic of the arm rest into the support plate openings.

Besides the drawbacks associated with accurately providing an underside recess in the arm rest, and utilizing extraneous screws as connecting means, the teaching in said U.S. Pat. No. 3,446,530 involves the additional drawback in the case of the optional plastic heat staking connection of having to undertake comparatively massive distribution and redistribution of portions of the plastic arm rest to fill the support plate openings neatly and evenly, while preventing unsightly overdistribution beyond the margins of the openings at the underside of the support plate, all of which add to the time, effort and other expense needed to fabricate this subassembly.

U.S. Pat. No. 3,203,731 and U.S. Pat. No. 3,291,523 (both to Krueger) concern various further types of stacking and/or ganging chairs, involving particular screw and other intricate connection means for attaching component parts to the chair frame. Moreover, U.S. Pat. No. 3,080,194; its reissue U.S. Pat. No. Re. 26,071; as well as U.S. Pat. No. 3,275,371; U.S. Pat. No. 3,278,227; U.S. Pat. No. 3,338,591; and U.S. Pat. No. 3,404,916 (all to Rowland); relate to still different stacking and/or ganging chair constructions contemplating further types of screw and other intricate connection arrangements, including brackets, channels, and the like, for attaching component parts to the chair frame, plus a special dolly for holding and transporting a large number of such chairs (i.e. U.S. Pat. No. 3,338,591).

Lastly, U.S. Pat. No. 3,671,074 (Bergstrom) shows a fabric covered tubular bipartite foldable chair arrangement in which fabric portions forming the chair back and chair seat are threaded onto the chair frame; U.S. Pat. No. 3,712,668 (Fink) shows a stacking and ganging chair arrangement having a foldable tablet arm, in which the seat and back are formed as a one piece member rigidly connected to mounting means on the chair frame; and U.S. Pat. No. 3,826,453 (Hitchcock) shows a stacking and ganging chair arrangement in which the plastic back and separate plastic seat are each apparently secured to the rod frame in edge wrap around fashion.

It is among the objects and advantages of the present invention to overcome the above discussed drawbacks and deficiencies in the prior art, and to provide body-supportive chair parts such as a separate chair back and/or a separate chair seat, containing specific means permitting the same to be secured to an appropriate accommodating chair frame to form the corresponding portion of a chair assembly, preferably a stacking and/or ganging chair assembly, and especially a combination of a chair frame containing such chair back and chair seat in secured disposition thereon, as well as a method for securing a particular chair part to the accommodating chair frame.

It is among the additional objects and advantages of the present invention to provide a chair part of the foregoing type, and preferably in the form of a chair back, having self-locking means for coacting locking engagement with a corresponding attachment portion of an appropriate accommodating chair frame, permitting self-securement of the separate chair part to the chair frame.

It is among the further objects and advantages of the present invention to provide a chair part of the foregoing type, and preferably in the form of a chair seat, having heat deformable and peripherally outwardly heat expansible hollow longitudinal means, preferably of locally heat deformable structural plastic, for in situ locking engagement with a corresponding attachment portion of an appropriate accommodating chair frame, permitting rigid securement of the separate chair part to the chair frame.

It is among the still further objects and advantages of the present invention to provide combinations of such separate chair parts, preferably with one such part being in the form of a chair back and the other such part being in the form of a chair seat, correspondingly secured to an appropriate accommodating chair frame, with the heat expansible hollow longitudinal means disposed in heat deformed peripherally outwardly expanded in situ condition in rigid securement with a receptively conforming portion of the chair frame.

It is among the still further objects and advantages of the present invention to provide a chair part of the foregoing type having linear recess means for insertion engagement with corresponding projection means on the chair frame, preferably in conjunction with the aforesaid self-locking means for coacting locking engagement with the chair frame, and especially recess means containing interior friction engagement means therealong for compressive engagement with such projection means on the chair frame, and more particularly friction engagement means which are deformable under mechanical force corresponding to the insertion engagement force of such projection means.

It is among the still further objects and advantages of the present invention to provide a method for securing to an appropriate accommodating chair frame, a chair part of the foregoing type having such heat expansible hollow longitudinal means, in which a separate heater element is used for locally applying heat and mechanical expansion pressure to the hollow longitudinal means to achieve in situ rigid securement of the chair part to the chair frame, and which avoids major or massive distribution and/or redistribution of portions of the material of the chair part thereat, e.g. as in the case of heat staking plastic material, and the need for excessive attention in order to obtain a neat and even appearance while preventing unsightly overdistribution of the deformed material beyond the intermediate margins at the connection site.

It is among the still further objects and advantages of the present invention to provide chair parts of the foregoing type and chair assemblies thereof with an appropriate accommodating chair frame, preferably in the form of stacking and/or ganging chair assemblies, which are relatively simple, rugged, troublefree and long-lasting in construction and use, as the case may be, which are comparatively inexpensive and easy to fabricate and assemble, which are readily produced from widely available materials and especially already existing types of chair frames, which involve an absolute minimum of individual components, and which avoid both the need for extraneous adhesives, screws or other intricate connection arrangements and the consequent time and effort to manipulate, align and accomplish connection of the pertinent parts, as well as the need for undue attention to precise and accurate dimensions and details of the interconnecting portions of the components.

Other and further objects and advantages of the present invention will become apparent from a study of the within specification and accompanying drawings, in which:

FIGS. 1 and 2 are schematic front and side views, respectively, of a chair assembly containing various embodiments of the present invention;

FIG. 4 is a schematic side sectional view taken along the line 4—4 of FIG. 1, showing further details of the chair frame of FIG. 3.

Figure 1:
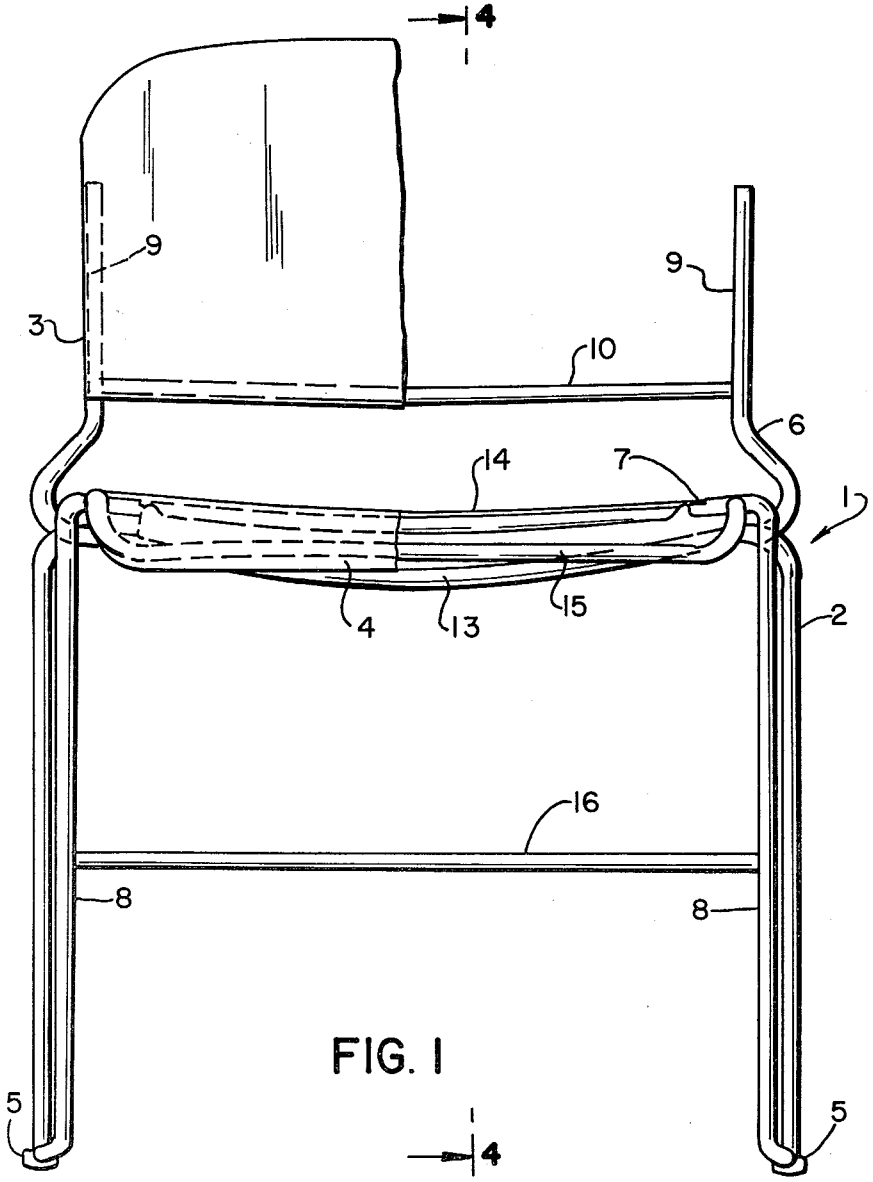
Figure 9:
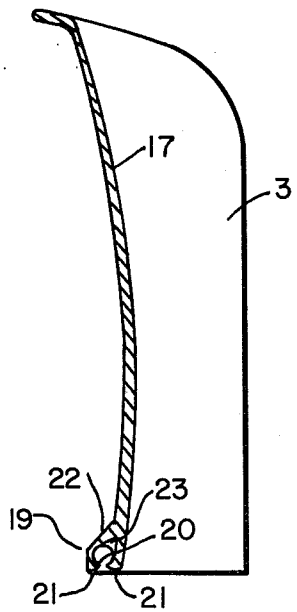
Figure 11:
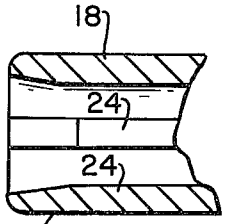
Figure 10:
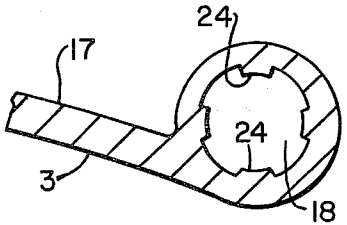
Figure 7:
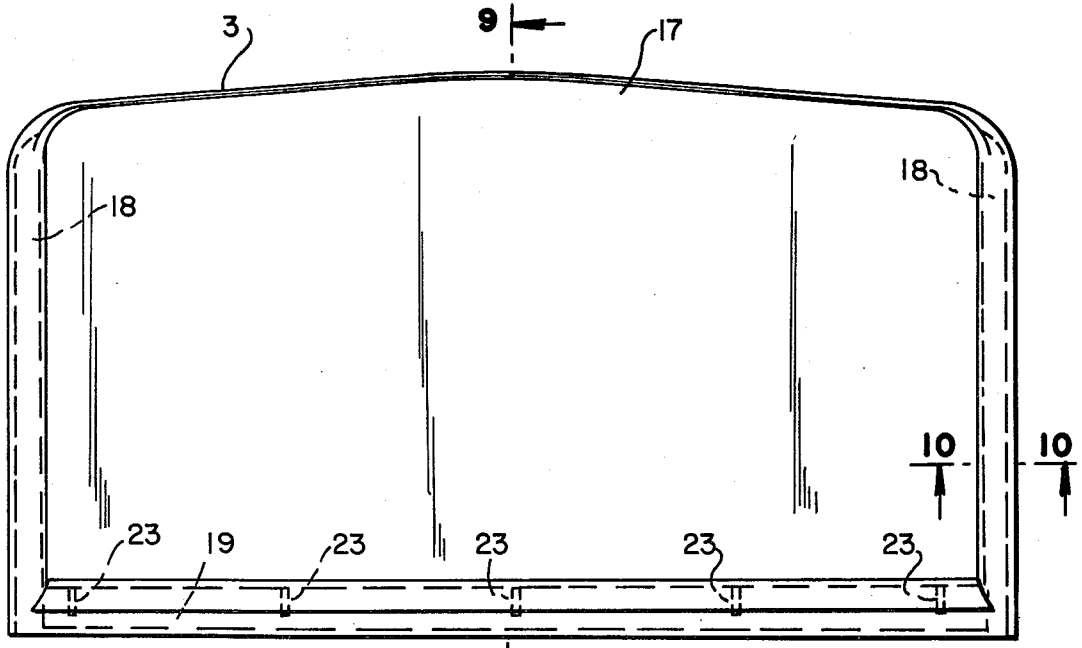
Figure 8:
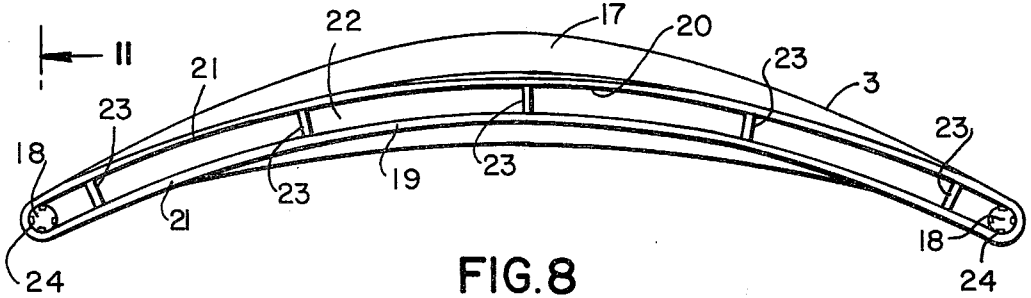
Figures 13, 14:
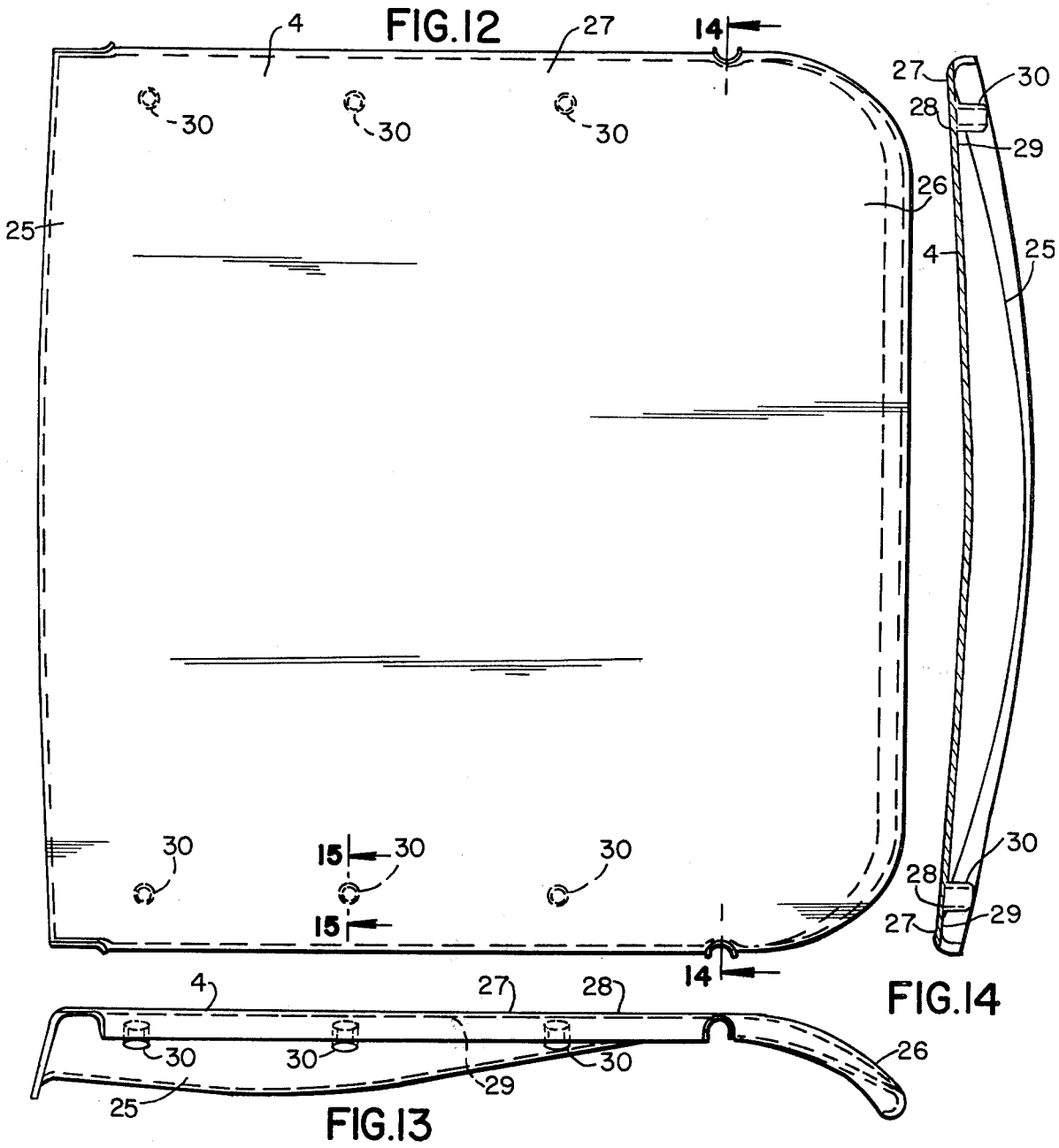
Figure 15:
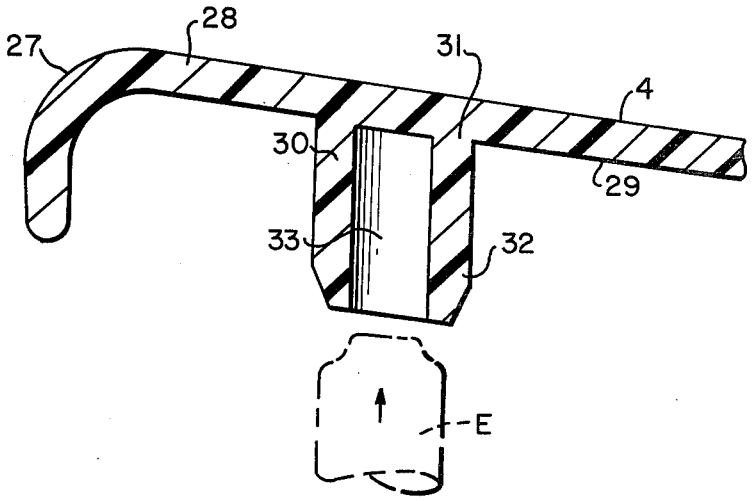
Figure 16:
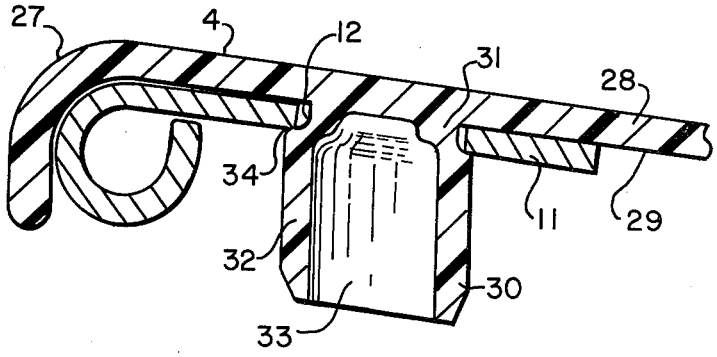

FIGS. 5 and 6 are schematic enlarged opposing sectional views, with FIG. 5 taken along the line 5—5 of FIG. 4, and indicating the disposition of the forward portion of the seat supporting side plate on the corresponding side of the chair frame, and with FIG. 6 taken along the line 6—6 of FIG. 4 in the opposite direction, and indicating the disposition of the rearward portion of the same seat supporting side plate;

FIGS. 7 and 8 are schematic rear and bottom views, respectively, of the separate chair back according to an embodiment of the invention as shown in FIGS. 1 and 2;

FIG. 9 is a schematic view taken along the line 9—9 of FIG. 7, and indicating the self-locking means for coacting locking engagement with the corresponding attachment portion appropriately provided therefor on the chair frame;

FIG. 10 is a schematic enlarged sectional view taken along the line 10—10 of FIG. 7, and indicating the linear recess means in the chair back for insertion engagement with the corresponding projection means appropriately provided therefor on the chair frame, as well as the interior friction engagement means contained in such recess means for compressive engagement with the projection means on the chair frame;

FIG. 11 is a schematic enlarged sectional view taken along the line 11—11 of FIG. 8, and indicating the longitudinal orientation of the interior friction engagement means at the entrance portion of the linear recess means;

FIGS. 12 and 13 are schematic top and side views, respectively, of the separate chair seat according to an embodiment of the invention as shown in FIGS. 1 and 2;

FIG. 14 is a schematic sectional view taken along the line 14—14 of FIG. 12, and indicating the disposition of the heat deformable and peripherally outwardly heat expansible hollow longitudinal means at the side portions of the chair seat;

FIG. 15 is a schematic enlarged sectional view taken along the line 15—15 of FIG. 12, and indicating the hollow longitudinal means in the form of a hollow boss on the underside of the chair seat prior to heat deformation and peripherally outward heat expansion, and further illustrating in phantom a separate heater element insertable into the hollow boss for locally applying heat and mechanical expansion pressure thereto when the chair seat is situated on the chair frame; and FIG. 16 is a schematic enlarged sectional view taken along the line 16—16 of FIG. 2, and indicating the hollow boss disposed in locally heat deformed and peripherally outwardly expanded in situ condition in rigid securement with a receptively conforming portion of the chair frame constituted by the seat supporting side plate thereof.

In accordance with one constructional aspect of the present invention, a chair construction is provided which comprises a body-supportive chair part, such as a chair back. Such chair part includes linear recess means such as in the form of a pair of laterally spaced apart linearly extending recess portions, adapted for insertion engagement with corresponding projection means such as a pair of laterally spaced apart projection portions of a chair frame, and self-acting locking means positioned on and connected, preferably integrally, to the chair part remote from the recess means or recess portions, and adapted for coacting locking engagement with a corresponding attachment means such as an attachment portion of the chair frame.

In this manner, the construction permits self-securement forthwith of the chair part to a receptively conforming chair frame such as an appropriate already existing type chair frame.

The locking means desirably include laterally elongate structurally supporting locking surface means extending along a portion of the width of the chair part. Thus, where the chair part is in the form of a chair back, including a pair of laterally spaced apart upwardly extending recess portions as the recess means, the locking surface means may advantageously include a correspondingly upwardly facing locking surface for automatic self-locking engagement with a rod on the chair frame.

More particularly, the locking surface means may include bilateral friction embracive surface means such as in the form of a locking channel, and the locking channel in turn may be conveniently provided as a resiliently flexible snap locking channel, preferably extending laterally along the width of the chair part intermediate of the recess portions, e.g. for engaging such rod. For this purpose, the chair part is desirably formed of resiliently flexible material such as plastic, e.g. polypropylene, which may be readily fabricated by conventional molding technique.

The recess portions of the chair part may be advantageously provided in the form of hollow closed sleeves, and these in turn may preferably contain interior friction engagement means therealong such as in the form of longitudinally extending beads, especially beads which are deformable under mechanical force corresponding to the insertion engagement force of the projection portions of the chair frame.

Hence, the above self-locking chair construction may be provided in a chair assembly which comprises in combination a chair frame having a back supporting portion including a pair of laterally spaced apart upwardly extending projection portions and an attachment portion remote from the projection portions, such as a portion of a rod intermediate such projection portions, and a separate chair back including a corresponding pair of laterally spaced apart upwardly extending recess portions disposed in insertion engagement with the projection portions, and a self-acting locking means positioned on and connected to the chair back remote from the recess portions and disposed in coacting locking engagement with the attachment portion, e.g. such rod, thereby self-securing the chair back to the back supporting portion of the chair frame.

In such chair back containing chair assembly, the locking means may advantageously include laterally elongate structurally supporting locking surface means extending along a portion of the width of the chair back, and the attachment portion may be constituted as a corresponding laterally elongate attachment portion extending along a portion of the width of the back supporting portion, with the locking surface means being in coacting structurally supporting locking engagement with the laterally elongate attachment portion.

More specifically, the locking surface means may include an upwardly facing locking surface, and the attachment portion may have a corresponding downwardly facing attachment surface, such that the locking surface is situated in coacting structurally supporting locking engagement with the attachment surface.

In the case where the locking surface means include bilateral friction embracive surface means, the attachment portion may be appropriately constituted as a corresponding bilaterally receptive attachment portion, whereby the bilateral surface means may be positioned in coacting structurally supporting bilateral friction embracive locking engagement with the bilaterally receptive attachment portion, e.g. in the form of such rod.

Preferably, in this regard, the bilateral surface means include a locking channel, especially a resiliently flexible snap locking channel extending laterally along the width of the chair back intermediate of the recess portions, and in turn the attachment portion specifically includes a rod interconnecting the projection portions, whereupon the locking channel may be disposed in coacting structurally suporting bilateral friction embracive locking engagement with the rod, while the rod desirably structurally interconnects the projection portions.

The above association of components is most advantageous where the chair back as noted above is formed of resiliently flexible material such as plastic.

In conjunction with the foregoing, the recess portions in the chair back are desirably constituted as hollow closed sleeves containing the longitudinally extending interior friction engagement beads therealong, such that the beads are disposed in compressive engagement with the corresponding projection portions which may be conveniently provided as upstanding rods.

By fashioning the beads as deformable structures which are deformable under mechanical force corresponding to the insertion engagement force of the projection portions or upstanding rods, the chair back may be readily positioned on the chair frame with the beads disposed in so deformed condition under the force of the compressive engagement of such projection portions therewith.

In accordance with another constructural aspect of the present invention, a chair construction is provided which comprises a body-supportive chair part, such as chair seat. Such chair part includes a contact surface portion, adapted for supporting engagement with a corresponding attachment aperture-containing plate portion of a chair frame, and a heat deformable and peripherally outwardly heat expansible hollow longitudinal means, preferably of locally heat deformable structural plastic. The hollow longitudinal means may be in the form of a hollow longitudinal boss connected to and extending outwardly from the contact surface portion, and adapted for insertion through and projection beyond the corresponding aperture of such a plate portion and in turn for heat deforming peripherally outward expansion in situ thereat beyond the perimetric confines of the aperture and sufficiently to bring the exterior of the resultant expanded longitudinal hollow boss into locking engagement with the adjacent marginal portions of the plate portion remote from the contact surface portion.

In this manner, the construction permits rigid securement of the chair part to a receptively conforming chair frame such as an appropriate already existing chair frame, especially one on which the earlier mentioned self-locking chair part, such as a counterpart chair back, may also be self-secured.

The boss desirably includes a hollow neck portion adjacent the contact surface portion for embracive insertion engagement with the surrounding transverse wall of the attachment aperture of such plate portion of the chair frame, and a free end hollow skirt portion remote from the contact surface portion and which upon heat deformation and peripheral outward heat expansion will lockingly engage the adjacent marginal portions of the plate portion remote from the contact surface portion.

The contact surface portion will normally include a planar wall portion of selective thickness for engaging the plate portion of the chair frame, and in turn the boss will be connected to the planar wall portion, yet will desirably have a longitudinal length of at least about three times the thickness of the planar wall portion whereby to accommodate the thickness of the intervening plate portion of the chair frame thereat and maintain sufficient internal structural integrity to assure a rugged in situ connection.

Initially, i.e. prior to in situ connection, the boss will similarly have a transverse internal width of more than the thickness of the planar wall portion for ample structural integrity thereat and sufficient for reception therein of an appropriate heater element for heat deforming and expanding the boss.

Preferably, the contact surface portion and boss are integral and the chair part is formed of heat deformable material such as locally heat deformable structural plastic, e.g. polypropylene.

Similarly, the above rigid securement chair construction may be provided in a chair assembly which comprises in combination a chair frame having a seat supporting portion including a plate portion containing an attachment aperture defined therethrough, and a separate chair seat including a corresponding contact surface portion disposed in supporting engagement with the plate portion, and a heat deformable and peripherally outwardly heat expansible hollow longitudinal boss connected to and extending outwardly from the contact surface portion and inserted through and projecting beyond the aperture and disposed in heat deformed and peripherally outwardly expanded in situ condition thereat beyond the perimetric confines of the aperture and with the exterior of the resultant expanded longitudinal hollow boss in locking engagement with the adjacent marginal portions of the plate portion remote from the contact surface portion, thereby rigidly securing the chair seat to the seat supporting portion of the chair frame.

In such chair seat containing chair assembly, correspondingly the boss may advantageously include a hollow neck portion adjacent the contact surface portion and situated in the aperture of the plate portion of the chair frame, and a free end hollow skirt portion remote from the contact surface portion and situated in heat deformed and peripherally outwardly expanded in situ condition beyond the perimetric confines of the aperture and with the exterior of the resultant expanded hollow skirt portion forming a shoulder in locking engagement with the adjacent marginal portions of the plate portion remote from the contact surface portion.

More specifically, as aforesaid, the plate portion of the chair frame normally includes a plate wall portion of selective thickness, the contact surface portion of the chair seat in turn concomitantly includes a planar wall portion of selective thickness, with the boss being connected to the planar wall portion and having a longitudinal length of at least about one and a half times the collective or combined thickness of the plate wall portion and planar wall portion, whereby, as noted above, to accommodate the thickness of the intervening plate portion of the chair frame thereat and maintain sufficient internal structure integrity to assure a rugged in situ rigid abutment connection thereat.

Moreover, in the same way, the neck portion of the boss will desirably have a transverse external width or diameter of at most substantially equal to that of the aperture in the plate wall portion of the chair frame and of more than about one and a half times the collective or combined thickness of the plate wall portion and planar wall portion, while the skirt portion will have an in situ expanded transverse external with or diameter substantially exceeding that of the aperture and of more than about two times the collective or combined thickness of the plate wall portion and planar wall portion, whereby to maintain sufficient internal structural integrity and assure a rugged in situ rigid abutment connection at the shoulder portion of the skirt portion.

Likewise, the neck portion will desirably have a transverse internal width or diameter of more than the thickness of the planar wall portion and sufficient for reception therein of the heater element for heat deforming and expanding the boss, while in turn the skirt portion will have an in situ expanded transverse internal width or diameter of more than the collective or combined thickness of the plate wall portion and planar wall portion consonant with the structural integrity and rigid abutment connection reasons noted above.

In corresponding manner, desirably the contact surface portion and boss are integral and the chair seat is formed of heat deformable material such as locally heat deformably structural plastic.

In accordance with a conjoint constructional aspect of the present invention, an overall chair construction may be provided which comprises an omnibus chair assembly, such as in the form of a stacking and/or ganging chair combination, of a chair frame having both a seat supporting portion and a back supporting portion of the foregoing type, plus a separate chair back according to said one aspect of the invention having said recess portions and self-acting locking means and being self-secured to the back supporting portion, as well as a separate chair seat according to said another aspect of the invention having said contact surface portion and said boss in heat deformed and expanded in situ condition and being rigidly secured to the seat supporting portion.

Regarding the associated method feature of the present invention, a method of securing a chair construction according to said another aspect of the invention to a chair frame is contemplated which compises, in a first step, arranging a separate body-supportive chair part, such as a chair seat, including a corresponding contact surface portion and a heat deformable and peripherally outwardly heat expansible hollow longitudinal boss connected to and extending outwardly from the contact surface portion, on a chair frame provided with a body-supportive chair part supporting portion including a plate portion containing an attachment aperture defined therethrough, to dispose the contact surface portion in supporting engagement with the plate portion and to insert the boss through and project such boss beyond the aperture. The associated second step comprises locally heat deforming and peripherally outwardly expanding the boss in situ beyond the perimetric confines of the aperture and sufficiently to bring the exterior of the resultant expanded longitudinal hollow boss into locking engagement with the adjacent marginal portions of the plate portion remote from the contact surface portion, thereby rigidly securing the chair part to the supporting portion of the chair frame.

Of course, as noted above, the chair part secured in accordance with the method is advantageously formed of locally heat deformable structural plastic, and preferably the chair part will constitute the chair seat and the supporting portion of the chair frame will constitute the corresponding seat supporting portion.

In carrying out such method, normally the heat deforming and expanding are effected by inserting a separate correspondingly selectively sized and shaped heater element into the hollow boss and applying heat and mechanical pressure peripherally outwardly against the surrounding hollow boss sufficient to deform and expand the portion of the boss projecting beyond the aperture into locking engagement with the adjacent marginal portions of the plate portion, and permitting the resultant boss to set by cooling in such in situ deformed and expanded condition.

Referring to the drawing, and initially to FIGS. 1 and 2, a chair assembly 1 is shown having a frame 2, a separate back 3 and a separate seat 4, and which is constituted as a stackable or stacking chair, permitting a number of such chairs to be easily and compactly stacked or nested vertically in one another, due to the relatively thin and flat conforming components making up the chair assembly.

By optionally providing conventional ganging connectors as at 5, 5 on one or both sides of frame 2, the chair assembly may also form a gangable or ganging chair, permitting it to be ganged with an adjacent chair (not shown) on one or both sides thereof, as the case may be, similarly equipped with counterpart coacting ganging connectors thereon, in the usual manner.

Frame 2 may be constituted as a solid rod, plate and strap frame, and is provided with a back supporting portion 6, a seat supporting portion 7 and legs 8, 8.

Back supporting portion 6 includes a pair of laterally spaced apart upwardly extending projections 9, 9, preferably parallel, and an attachment portion such as in the form of rear spreader rod 10 structurally interconnecting the projections, e.g. by welding, at a level generally downwardly remote from the upper free ends thereof. Rod 10 is normally provided as an outwardly and rearwardly curved rod for accommodating the profile and contour of the back 3.

Figure 3:
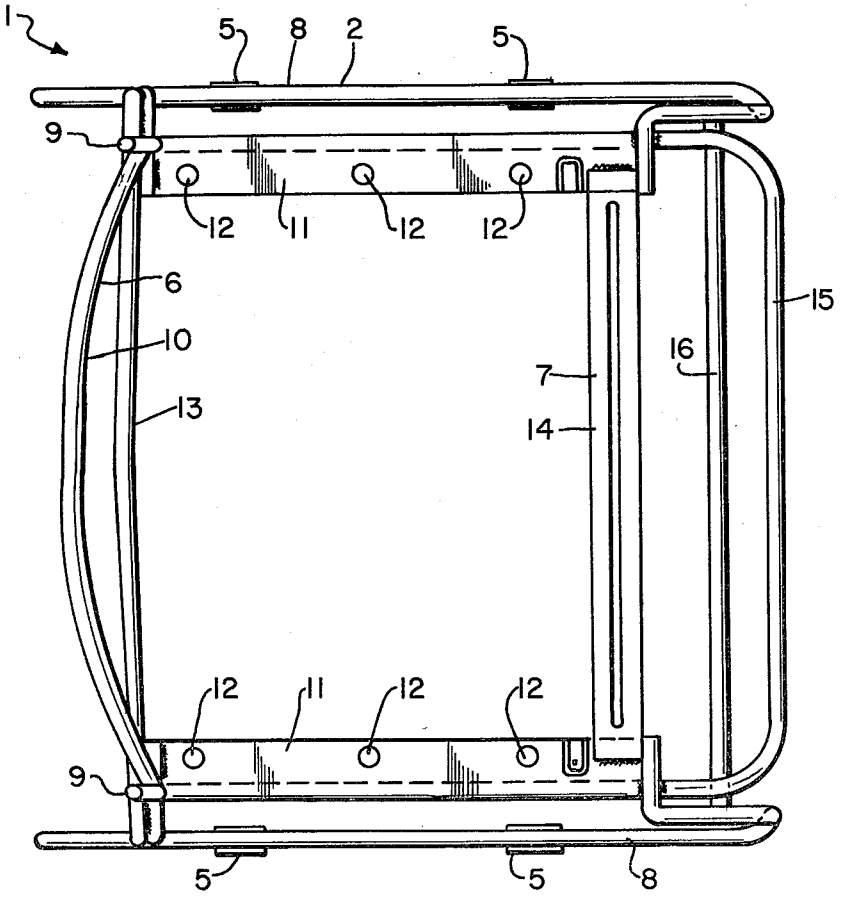
FIG. 3 is a schematic top view of an appropriate accommodating chair frame corresponding to that in FIGS. 1 and 2, with the separate chair back and chair seat according to the invention removed to illustrate details of basic construction.

Seat supporting portion 7 includes a pair of side plates 11, 11 attached to the adjacent framework, e.g. by welding, and correspondingly containing a plurality of selectively sized and shaped front to rear aligned attachment apertures 12, 12 defined therethrough (see FIGS. 3 and 4). Plates 11, 11 are conveniently disposed as flat surface metal plates slightly inwardly and downwardly inclined to each other for accommodating the profile and contour of the seat (see FIGS. 5 and 6).

For added structural conforming support, the frame 2 may contain in the seat supporting portion 7 an appropriate rear cross rod 13, seat strap 14 and front cross rod 15, as well as a leg spreader rod 16 between the legs.

It will be seen that the overall profile and contour of the frame 2 lends itself to stacking with chair frames of the same general type, without undue binding between the chairs and without various projections thereon interfering with the proper nesting orientation desired.

The separate back 3 constitutes a body-supportive chair part of curved profile and contour conforming to the back of the chair user and at the same time lending itself to convenient chair stacking. It is especially formed with a broad relatively flat surfaced curvilinear shaped central web portion 17, bounded on the lateral sides thereof by a pair of laterally spaced apart linearly upwardly extending peripherally completely enclosed hollow recess portions such as in the form of hollow closed sleeves 18, 18, preferably parallel, and along the bottom portion thereof by a similar curvilinear shaped self-acting locking means 19, positioned at least insofar as its central portion is concerned remote from the sleeves 18, 18 (see FIGS. 7 to 9).

Sleeves 18, 18 are open at their bottom ends and closed at their upper ends, and are concordantly selectively sized and arranged for insertion engagement with the projections 9, 9, whereas locking means 19 is concordantly selectively sized and arranged for coacting, self-acting locking engagement with the attachment portion as constituted by rod 10. In this manner, the back 3 may be simply and easily self-secured to the receptively conforming back supporting portion 6, with no need for extraneous adhesives, screws or other intricate connection arrangements (see FIGS. 1 and 2).

Locking means 19 preferably include laterally elongate structurally supporting locking surface means extending along at least a portion of the width of the back 3, i.e. along the underside of the central web portion 17, conveniently containing an upwardly facing locking surface 20 (see FIGS. 8 and 9). More particularly, the locking surface means may take the form of bilateral friction embracive surface means or jaws 21, 21 containing a locking channel 22 therebetween. Desirably, the locking channel 22 is formed as a resiliently flexible snap locking channel, extending laterally along the width of the back 3 intermediate the sleeves 18, 18.

The channel 22 may favorably contain reinforcing abutment ribs 23 of concave underside shape (FIG. 9), internally therein and at a plurality of spaced points therealong. Such concave ribs 23 serve for engaging the adjacent upper surface corresponding contour portion of the spreader rod 10, constituting the attachment portion of the back supporting portion 6 onto which the locking means 19 self-actingly locks. At the same time, ribs 23 serve to contribute structural integrity to the channel 22 and maintain its working jaws 21, 21 in tight permanent snap locking relation over the rod 10.

The sleeves 18, 18 are preferably provided with interior friction engagement means therealong such as in the form of longitudinally extending beads 24. These desirably circumferentially spaced apart beads 24 are advantageously deformable under mechanical force corresponding to the insertion engagement force of the projections 9, 9 (see FIGS. 10 and 11).

By appropriately forming the back 3 of resiliently flexible material such as structural plastic, effective self-acting snap locking characteristics can be inherently imparted to the locking means 19, and especially to the bilateral friction embracive surface means or jaws 21,21 containing the locking channel 22, and at the same time deformable characteristics of the desired type can be inherently imparted to the longitudinally extending beads in the sleeves 18,18.

It will be appreciated that because of the nature and disposition of the spaced apart upwardly extending recess portions or sleeves 18,18 and the self-acting locking means 19, the latter need only be provided at a limited area remote from the former, e.g. at a point laterally intermediate the sleeves, for adequate appropriate coacting locking engagement with the attachment portion of the back supporting portion 6, e.g. itself locatable at a point laterally intermediate the projections 9,9 on rod 10.

Nevertheless, by extending the locking means 19 laterally along the full bottom extent of the central web portion 17 between the open ends of sleeves 18,18, and in turn the attachment portion along the full lateral extent of the back supporting portion 6, i.e. as a laterally elongate portion along the full extent of rod 10 between the upstanding projections 9,9, a concomitantly increased zone of support and reinforcement will be provided between the back 3 and the back supporting portion 6, and especially along the linear extent of the self-acting permanent locking connection between the jaws 21,21 and the rod 10.

Considering the curved contour of the width of the back 3, and of the jaws 21,21 in conjunction with rod 10, all in relation to the flat or straight disposition of the upstanding generally parallel lateral side edges of the back 3, and of the sleeves 18,18 in conjunction with the projections 9,9, a structurally enhanced composite permanently connected system is provided between the chair frame 2 and the chair block 3. Not only will the rod 10, interconnecting the projections 9,9, resist twisting the torsional forces at the back portion of the chair, but also the curvilinear contour interconnection between the parallel projections and sleeves, on the one hand, and the curved rod and jaws extending transversely thereto, on the other hand, will augment such resistance and enhance the locking connection between the component parts.

More specifically, the generally right angular orientation between a transverse horizontal plane passing through the rearwardly curved rod 10 and jaws 21,21 and a lateral vertical plane passing through the parallel projections 9,9 and sleeves 18,18, defines a spatial structural configuration of increased reinforcing stabilization characteristics, considering the corresponding right angular welded connection between the projections and rod taken with the concomitant right angular integral connection between the sleeves and jaws through the intermediate expanse of the web portion 17. The full curved width of the connection between the jaws and rod will, of course, provide a more positive stable connection than would be possible with a corresponding straight line connection in a flat plane passing through the projections and sleeves and having a length measured by the flat linear width between the projections rather than the curved linear width constituted by the greater running length of the rod (cf. FIGS. 2 and 3).

Thus, the back 3 may be merely positioned with the sleeves 18,18 inserted downwardly onto the projections 9,9 until the jaws 21,21 engage the rod 10, whereupon a further downward manual push will effectively serve to snap lock the jaws in self-acting locking engagement with the rod, to secure the back more less permanently on the rod with the beads 24 in deformed condition under the mechanical force of the compressive engagement of the projections embraced by the circumferentially enclosing sleeves thereat. The upwardly facing locking surface 20, i.e. within the channel 22, with effectively embrace the adjacent underside or downwardly facing attachment surface portion of the rod thereat in coacting structurally supporting locking engagement therewith. More specifically, the jaws will effectively bilaterally embrace both sides of the rod which provides a corresponding bilaterally receptive attachment portion for this purpose.

The separate seat 4 also constitutes a body-supportive chair part of curved profile and contour conforming to the seat of the chair user, and likewise lending itself to convenient stacking. It contains a more or less rear well 25, a downwardly and forwardly curved front end 26 and substantially flat sides 27, 27 (see FIGS. 3 to 4 and 12 to 14) for appropriate disposition on the chair frame 2.

Each side 27 is formed with a planar wall portion 28 having a contact surface 29 on its underside, adapted for supporting engagement with a corresponding side plate 11 of the chair frame 2, and also a plurality of heat deformable and peripherally outwardly heat expansible hollow longitudinal means such as in the form of bosses 30. The bosses 30 are connected to and extend outwardly from the contact surface 29 at each side 27 of the seat 4 and are adapted for insertion through and projection beyond the corresponding attachment apertures 12 of the side plate 11 thereat.

Hence, the bosses 30 are selectively sized and arranged and provided in concordant number relative to the apertures 12 in the particular side plate 11 for downwardly inserted accommodation thereat, while the surrounding contact surface 29 at the corresponding side 27 of the seat 4 thereat in turn will engage supportingly downwardly against such side plate 11.

Each such boss 30 appropriately includes a hollow neck 31 adjacent the contact surface 29 and a free end hollow skirt 32 remote from such contact surface (see FIG. 15).

With respect to the selective thickness of the planar wall portion 28 of the seat 4, i.e. at least in the general area where the corresponding boss 30 is connected thereto at its hollow neck 31, such boss is advantageously provided with a longitudinal length of at least about three times the thickness dimension of the planar wall portion whereby to accommodate the appropriate concordant selective thickness of side plate 11 in the vicinity of the apertures 12 and provide sufficient mechanical integrity for a stable connection to be achieved upon in situ connection thereat, as aforesaid.

For similar reasons, and to accommodate the conventional heater element E (shown in phantom in FIG. 15) for heat deforming and expanding the boss, the latter will conveniently initially have a transverse internal width or diameter dimension of more than the thickness of the planar wall portion 28, i.e. taken as a reference standard, as well as sufficient for operative reception therein of the heater element E.

For best results, the boss 30 and heater element E will be concordantly selectively sized and shaped, and preferably will be annular and cylindrical, respectively, in transverse cross section. Once the seat 4 is placed on frame 2 with the bosses 30 inserted in the apertures 12, this will permit the heater element to engage the mouth at the free end of each hollow skirt 32 in turn, and travel upwardly through the hollow interior 33 to the hollow neck 31 and into eventual abutment with the underside of the planar wall portion 28 thereat, as the heater element under slight upwardly or inwardly urging force travels farther into the interior 33 of the hollow boss and progressively heats by conductive contact the body of the skirt 32 (see FIG. 15). Thus, boss 30 will have a constant and uniform internal and external diameter throughout its effective length.

A counterweight on the seat thereabove or downward manual force thereagainst may be utilized, if desired, to prevent upward separation of the seat from the frame during the time the heater element is being upwardly urged into the interior of the hollow boss.

As this progressive heating and upward and inward travel occurs, the corresponding boss 30 will become heat deformed and will peripherally outwardly expand in situ in the associated aperture 12 and beyond the perimetric confines of such aperture, and sufficiently to bring the exterior of the resultant expanded longitudinal hollow boss, as at annular shoulder or ridge 34, into locking engagement with the adjacent marginal portions of the side plate 11 remote from the contact surface 29 (see FIG. 16).

As a result, the seat 4 will become rigidly and permanently secured to the respectively conforming apertured side plate 11 of the frame 2. Such will occur in simple and efficient manner, in a short heating and deforming operation, without the need for a complex set up of the parts to be connected, or special arrangement thereof to one another, save for their intended abutting coacting relation, and merely using, e.g. manually, a rudimentary heater element type conventional tool.

Such heater element may comprise a simple contact tool of the electrical resistance heating type (not shown) having a suitably shaped heating probe end portion insertable operatively into the boss in question. It will be appreciated that in fact the boss after heat deformation and peripheral expansion will take the exact form and shape of the probe end portion of the heater element (cf. FIGS. 15 and 16). A precise deformation will readily occur and the boss, once set in situ, will be neat and clean in appearance and be free from unsightly distributed or redistributed masses of plastic at the heating and connection site.

The various advantages of this aspect of the invention will be enhanced by the desirable fashioning of the bosses 30 integral with the contact surface 29 and/or planar wall portion 28 and by likewise providing the appropriate structural material thereat as locally heat deformable plastic. The wall of the boss is generally uniform and constant in its thickness dimension, more or less throughout its longitudinal extent, both before and after deformation and expansion (see FIGS. 15 and 16), even along the peripherally outward or radially offset portion thereof at shoulder 34.

Considering the selective thickness of the planar wall portion 28 as a reference standard, and for the aforementioned reasons, the boss in situ in heat deformed and expanded rigid connecting relation to the side plate 11, suitably possesses a longitudinal length of at least about one and a half times the collective thickness of the planar wall portion 28 and the similarly selectively dimensioned side plate 11, whose thickness may be more or less the same as or somewhat less than that of the planar wall portion (see FIG. 16). Generally, the side plate 11 will be formed of metal while the seat 4 will be made of plastic, such that the metal component may be favorably provided of thinner planar material than that of the seat without sacrificing structural integrity or stability.

After heat deformation expansion, the slight dimensional offset at the shoulder 34 will neither significantly change the overall longitudinal dimension of the boss, nor significantly alter the uniform and constant thickness dimension of the wall defining the hollow interior 33.

Hence, both before and after heat deformation and expansion, the neck 31 will posses a transverse external width or diameter of at most substantially equal to the width or diameter of the corresponding aperture 12, yet preferably of more than about one and a half times the collective thickness of the side plate 11 and planar with portion 28.

On the other hand, after heat deformation and expansion, the skirt 32 will have an in situ expanded transverse external width or diameter substantially exceeding the corresponding width or diameter of the aperture 12 thereat and sufficient to provide the shoulder 34, yet preferably of more than about two times the collective thickness dimension of the planar wall portion 28 and side plate 11, for the same reasons noted above.

Concordantly, the neck 31 will desirably possess a transverse internal width or diameter of more than the thickness dimension of the planar wall portion 28 and sufficient for reception of the heater element E, while the skirt 32 will likewise possess an in situ expanded transverse internal width or diameter of more than the collective thickness dimension of the side plate 11 and planar wall portion 28.

It will be realized, in this regard, that the three dimensional spatial volume represented by the particular hollow boss 30 will be far greater than the essentially two dimensional planar constitution of the planar wall portion 28 and side plate 11, and that thereby the boss will provide an enhanced stable structural reinforcement interconnection between the component parts by means having pronounced breadth as well as length and width, as compared with a planar connection using means having only two dimensional length and width similar to the planar wall portion 28 and side plate 11 themselves to be connected by such planar connection.

In actuality, the boss 30 by reason of the heat deformation and expansion will assume a conforming internal and external profile to that of the heater element E, providing a robust rigid and permanent connection as well as a neat and pleasing appearance and contour design (see FIGS. 2 and 16). For efficient and favorable results, the bosses and apertures will all be uniformly sized and shaped for cooperating interconnection therebetween. Upon cooling, the bosses, spread to take the corresponding selective shape of the heater element E, will only slightly contract at best, yet their cooled in situ disposition in any case will be sufficient to insure a tight connection at the shoulders 34 with the margins of the side plate adjacent the corresponding apertures 12.

Thus, in accordance with the conjoint method, the heater element E may be conveniently inserted into the respective hollow boss 30 after the latter is in place inserted in its coacting aperture 12, and heat and mechanical expansion pressure or force may then be applied by the heater element peripherally outwardly against the surrounding local areas of the hollow boss sufficient to deform and expand the portion of the boss, constituted by the skirt 32, projecting beyond the aperture, and into locking engagement, via the shoulder 34 created thereby, with the adjacent marginal portions of the side plate 11. The heater element may then be removed to permit the resultant boss to cool and set in such in situ deformed and expanded condition.

According to the foregoing, an advantageous stacking and/or ganging type chair assembly may be conveniently provided, in which the separate chair back is easily self-snap locked and permanently secured to the back supporting portion of the chair frame and the separate chair seat is readily permanently rigidly secured by heat deformation and expansion of bosses in situ to the seat supporting portion of such chair frame, utilizing the stated method.

It is clear from the above that such method avoids major or massive distribution and/or redistribution of portions of the material of the chair seat thereat, e.g. as occurs in the case of heat staking plastic material, and likewise avoids the need for excessive attention to obtain a neat and even appearance, while preventing unsightly overdistribution of the deformed material beyond the immediate margins at the connection site.

It is furthermore clear that the formed chair assembly is relatively simple, rugged, trouble-free and long-lasting in construction and use, as the case may be, and that it is comparatively inexpensive and easy to fabricate and assemble from readily provided widely available materials and especially already existing type of chair frames. Moreover, the instant chair assembly clearly involves an absolute minimum of individual components which may be suitably and efficiently secured together more or less permanently without the need for extraneous adhesives, screws or other intricate connection arrangements and the consequent time and effort to manipulate, align and accomplish connection of the pertinent parts, and additionally without the need for undue attention to precise and accurate dimensions and details of the interconnecting portions of the components.

It will be appreciated that the foregoing specification and drawings are set forth by way of illustration and not limitation, and that various changes and modifications may be made therein without departing from the spirit and scope of the present invention, which is to be limited solely by the scope of the appended claims:

What is claimed is:

1. Chair construction comprising a body-supportive chair part including a pair of laterally spaced apart linearly extending peripherally completely enclosed longitudinal recess portions, disposed in a reference plane and adapted for longitudinal insertion engagement with corresponding longitudinal projection portions of a chair frame, and self-acting locking means positioned on and connected to the chair part remote from the recess portions, and including laterally elongate structurally supporting curvilinear locking surface means curvilinearly extending along a portion of the width of the chair part and disposed substantially transversely of the longitudinal recess portions and in spaced relation to the reference plane and adapted for coacting locking engagement with a corresponding attachment portion of such chair frame, whereby to permit self-securement of the chair part to a receptively conforming chair frame.

2. Construction according to claim 1 wherein the chair part is a chair back formed of resiliently flexible material and includes a pair of laterally spaced apart upwardly extending recess portions, and the locking surface means include an upwardly facing locking surface.

3. Construction according to claim 2 wherein the locking surface means include bilateral friction embracive surface means forming a resiliently flexible snap locking channel extending laterally along the width of the chair part intermediate of the recess portions.

4. Construction according to claim 1 wherein the recess portions are in the form of hollow closed sleeves containing interior friction engagement means therealong in the form of longitudinally extending beads, and the beads are deformable under mechanical force corresponding to the insertion engagement force of such projection portions.

5. Chair construction comprising in combination a chair frame provided with a back supporting portion including a pair of laterally spaced apart upwardly extending projection portions and an attachment portion remote from the projection portions, and a separate chair back including a corresponding pair of laterally spaced apart upwardly extending recess portions disposed in insertion engagement with said projection portions, and self-acting locking means positioned on and connected to the chair back remote from the recess portions and disposed in coacting locking engagement with said attachment portion, thereby self-securing the chair back to the back supporting portion of the chair frame.

6. Construction according to claim 5 wherein the locking means include laterally elongate structurally supporting locking surface means extending along a portion of the width of the chair back and the attachment portion is a corresponding laterally elongate attachment portion extending along a portion of the width of the back supporting portion, and the locking surface means are in coacting structurally supporting locking engagement with the laterally elongate attachment portion.

7. Construction according to claim 6 wherein the locking surface means include an upwardly facing locking surface and the attachment portion has a corresponding downwardly facing attachment surface, and the locking surface is in coacting structurally supporting locking engagement with the attachment surface.

8. Construction according to claim 6 wherein the locking surface means include bilateral friction embracive surface means at the attachment portion is a corresponding bilaterally receptive attachment portion, and the bilateral surface means are in coacting structurally supporting bilateral friction embracive locking engagement with the bilaterally receptive attachment portion.

9. Construction according to claim 8 wherein the bilateral surface means include a locking channel and the attachment portion includes a rod, and the locking channel is in coacting structurally supporting bilateral friction embracive locking engagement with the rod.

10. Construction according to claim 9 wherein the locking channel is a resiliently flexible snap locking channel and extends laterally along the width of the chair back intermediate of the recess portions, and the rod structurally interconnects the projection portions.

11. Construction according to claim 5 wherein the chair back is formed of resiliently flexible material.

12. Construction according to claim 11 wherein the resiliently flexible material is plastic.

13. Construction according to claim 5 wherein the recess portions are in the form of hollow closed sleeves containing longitudinally extending interior friction engagment beads therealong in compressive engagement with the corresponding projection portions.

14. Construction according to claim 13 wherein the beads are deformable under mechanical force corresponding to the insertion engagement force of the projection portions and are disposed in so deformed condition under the force of the compressive engagement of the projection portions therewith.

15. Chair construction comprising a chair frame provided with a chair part supporting portion including a plate portion containing an attachment aperture defined therethrough, and a body-supportive chair part including a contact surface portion disposed in supporting engagement with the corresponding attachment aperture-containing plate portion of the chair frame, and a heat deformable and peripherally outwardly heat expansible hollow longitudinal boss connected to and extending outwardly from the contact surface portion and inserted through and projecting beyond the corresponding aperture of such plate portion and in turn disposed in heat deformed peripherally outwardly expanded in situ condition thereat beyond the perimetric confines of the aperture and with the exterior of the resultant expanded longitudinal hollow boss in locking engagement with the adjacent marginal portions of the plate portion remote from the contact surface portion, thereby rigidly securing the chair part to the chair part supporting portion of the chair frame.

16. Construction according to claim 15 wherein the contact surface portion and boss are integral.

17. Construction according to claim 15 wherein the chair part is formed of heat deformable material.

18. Chair construction comprising in combination a chair frame provided with a seat supporting portion including a plate portion containing an attachment aperture defined therethrough, and a separate chair seat including a corresponding contact surface portion disposed in supporting engagement with the plate portion, and a heat deformable and peripherally outwardly heat expansible hollow longitudinal boss connected to and extending outwardly from the contact surface portion and inserted through and projecting beyond the aperture and disposed in heat deformed peripherally outwardly expanded in situ condition thereat beyond the perimetric confines of the aperture and with the exterior of the resultant expanded longitudinal hollow boss in locking engagement with the adjacent marginal portions of the plate portion remote from the contact surface portion, thereby rigidly securing the chair seat to the seat supporting portion of the chair frame.

19. Construction according to claim 18 wherein the boss includes a hollow neck portion adjacent the contact surface portion and situated in the aperture and a free end hollow skirt portion remote from the contact surface portion and situated in heat deformed peripherally outwardly expanded in situ condition beyond the perimetric confines of the aperture and with the exterior of the resultant expanded hollow skirt portion forming a shoulder in locking engagement with the adjacent marginal portions of the plate portion remote from the contact surface portion.

20. Construction according to claim 19 wherein the plate portion includes a plate wall portion of selective thickness, the contact surface portion includes a planar wall portion of selective thickness, and the boss is connected to the planar wall portion and has a longitudinal length of at least about one and a half times the collective thickness of the plate wall portion and planar wall portion.

21. Construction according to claim 20 wherein the neck portion has a transverse external width of at most substantially equal to the width of the aperture and of more than about one and a half times the collective thickness of the plate wall portion and planar wall portion, and the skirt portion has an in situ expanded transverse external width substantially exceeding the width of the aperture and of more than about two times the collective thickness of the plate wall portion and planar wall portion.

22. Construction according to claim 21 wherein the neck portion has a transverse internal width of more than the thickness of the planar wall portion and sufficient for reception therein of a heater element for heat deforming and expanding the boss, and the skirt portion has an in situ expanded transverse internal width of more than the collective thickness of the plate wall portion and planar wall portion.

23. Construction according to claim 18 wherein the contact surface portion and boss are integral.

24. Construction according to claim 18 wherein the chair seat is formed of heat deformable material.

25. Construction according to claim 18 wherein the heat deformable material is locally heat deformable plastic.

26. Chair construction according to claim 18 comprising a stacking chair combination of a chair frame provided with both a seat supporting portion and a back supporting portion, the seat supporting portion including a plate portion containing an attachment aperture defined therethrough, and the back supporting portion including a pair of laterally spaced apart upwardly extending projection portions and an attachment portion remote from the projection portions, a separate chair seat including a corresponding contact surface portion disposed in supporting engagement with the plate portion, and a heat deformable and peripherally outwardly heat expansible hollow longitudinal boss connected to and extending outwardly from the contact surface portion and inserted through and projecting beyond the aperture and disposed in heat deformed peripherally outwardly expanded in situ condition thereat beyond the perimetric confines of the aperture and with the exterior of the resultant expanded longitudinal hollow boss in locking engagement with the adjacent marginal portions of the plate portion remote from the contact surface portion, thereby rigidly securing the chair seat to the seat supporting portion of the chair frame, and a separate chair back including a corresponding pair of laterally spaced apart upwardly extending recess portions disposed in insertion engagement with said projection portions, and self-acting locking means positioned on and connected to the chair back remote from the recess portions and disposed in coacting locking engagement with said attachment portion, thereby self-securing the chair back to the back supporting portion of the chair frame.

27. Construction according to claim 26 wherein the chair seat is formed of locally heat deformable plastic and the chair back is formed of resiliently flexible plastic.

28. Method of providing a chair construction according to claim 15 by securing a corresponding chair part to a chair frame comprising arranging a separate body-supportive chair part including a corresponding contact surface portion and a heat deformable and peripherally outwardly heat expansible hollow longitudinal boss of constant uniform internal and external diameter connected to and extending outwardly from the contact surface portion and including a hollow neck portion adjacent the contact surface portion and a free end hollow skirt portion remote from the contact surface portion, on a chair frame provided with a body-supportive chair part supporting portion including a corresponding plate portion containing an attachment aperture defined therethrough, to dispose the contact surface portion in supporting engagement with the plate portion and to insert the box through and project the skirt of such boss beyond the aperture, and locally heat deforming and peripherally outwardly expanding the skirt of the boss in situ thereat beyond the perimetric confines of the aperture and sufficiently to bring the exterior of the resultant expanded longitudinal hollow boss into locking engagement with the adjacent marginal portions of the plate portion remote from the contact surface portion, thereby rigidly securing the chair part to the supporting portion of the chair frame.

29. Method according to claim 28 wherein the heat deforming and expanding are carried out by inserting a heater element into the hollow boss and applying heat and mechanical expansion pressure peripherally outwardly against the surrounding hollow boss sufficient to deform and expand the portion of the boss projection beyond the aperture into locking engagement with the adjacent marginal portions of the plate portion, and permitting the resultant boss to set in such in situ deformed and expanded condition.

* * * * *